US009821212B2

(12) United States Patent
Kolman et al.

(10) Patent No.: US 9,821,212 B2
(45) **Date of Patent: *Nov. 21, 2017**

(54) METHOD OF CONTROLLING AN EXERCISE APPARATUS

(71) Applicants: Andrew J Kolman, Madison, WI (US); Matthew D Wittenberg, Waunakee, WI (US); Timothy E Bank, Fitchburg, WI (US); Mark J Van Handel, Greenfield, WI (US); Shanan Galligan, Madison, WI (US)

(72) Inventors: Andrew J Kolman, Madison, WI (US); Matthew D Wittenberg, Waunakee, WI (US); Timothy E Bank, Fitchburg, WI (US); Mark J Van Handel, Greenfield, WI (US); Shanan Galligan, Madison, WI (US)

(73) Assignee: JOHNSON HEALTH TECH CO., LTD., Taichung Hsien (TW)

( * ) Notice: Subject to any disclaimer, the term of this patent is extended or adjusted under 35 U.S.C. 154(b) by 42 days.

This patent is subject to a terminal disclaimer.

(21) Appl. No.: 14/469,537

(22) Filed: Aug. 26, 2014

(65) Prior Publication Data

US 2016/0059071 A1 Mar. 3, 2016

Related U.S. Application Data

(63) Continuation of application No. 13/738,954, filed on Jan. 10, 2013, now Pat. No. 8,840,526, which is a (Continued)

(30) Foreign Application Priority Data

May 27, 2009 (TW) ..... 098117912 A

(51) Int. Cl.
*A63B 24/00* (2006.01)
*A63B 21/005* (2006.01)
(Continued)

(52) U.S. Cl.
CPC ..... *A63B 71/0622* (2013.01); *A63B 22/00* (2013.01); *A63B 23/00* (2013.01);
(Continued)

(58) Field of Classification Search
USPC ..... 482/1, 4, 7, 901, 902
See application file for complete search history.

(56) References Cited

U.S. PATENT DOCUMENTS 4,934,694 A * 6/1990 McIntosh ..... B23P 19/066 482/137
5,054,774 A * 10/1991 Belsito ..... A63B 24/00 345/173

(Continued)

*Primary Examiner* — Sundhara Ganesan
*Assistant Examiner* — Shila Jalalzadeh Abyan
(74) *Attorney, Agent, or Firm* — Michael Best & Friedrich LLP

(57) ABSTRACT

A method for controlling an exercise apparatus via a control interface of an exercise apparatus, including steps of controlling a touch screen to display an information field, and then monitoring the touch screen to detect whether a touch has occurred on the surface of the touch screen and whether the touch is located in an input zone which has a plurality of sensing areas in the information field. A user can use specific actions to operate the exercise apparatus from one condition of using a first speed value to another condition of using a second speed value.

10 Claims, 12 Drawing Sheets

Related U.S. Application Data continuation of application No. 13/349,549, filed on Jan. 12, 2012, now Pat. No. 8,360,934, which is a continuation of application No. 12/605,375, filed on Oct. 26, 2009, now Pat. No. 8,113,990.

(51) Int. Cl.

| | |
|---|---|
| ***A63B 71/00*** | (2006.01) |
| ***A63B 15/02*** | (2006.01) |
| ***A63B 71/06*** | (2006.01) |
| *A63B 22/00* | (2006.01) |
| *A63B 23/00* | (2006.01) |

(52) U.S. Cl.

CPC . *A63B 2071/065* (2013.01); *A63B 2071/0641* (2013.01); *A63B 2071/0658* (2013.01)

(56) References Cited

U.S. PATENT DOCUMENTS 5,512,025 A * 4/1996 Dalebout ..... A63B 22/025 482/54
8,113,990 B2 * 2/2012 Kolman ..... A63B 71/0619 482/4

* cited by examiner

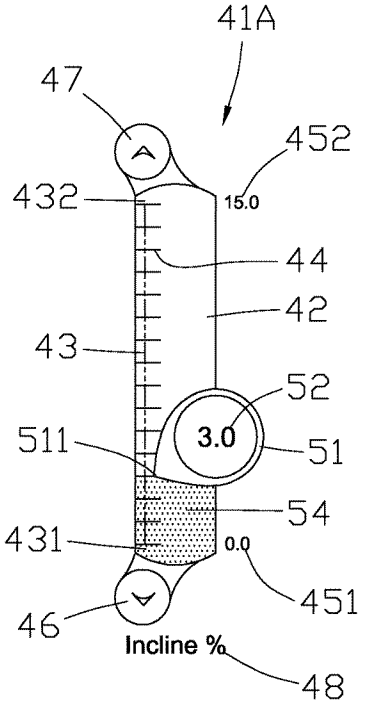
Fig. 4-a
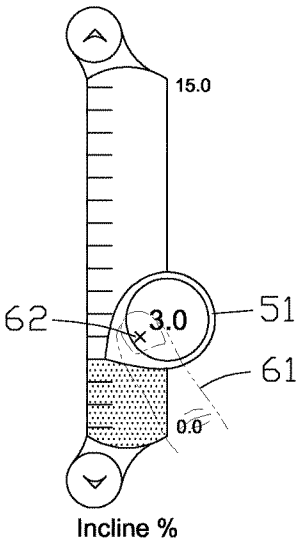
Fig. 4-b
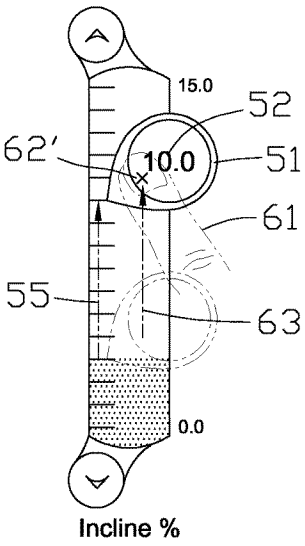
Fig. 4-c
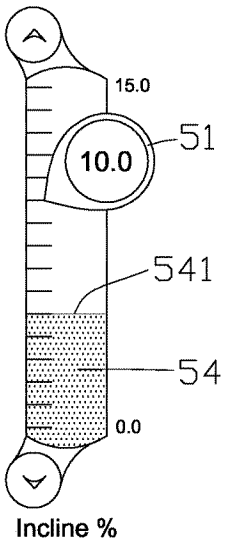
Fig. 4-d
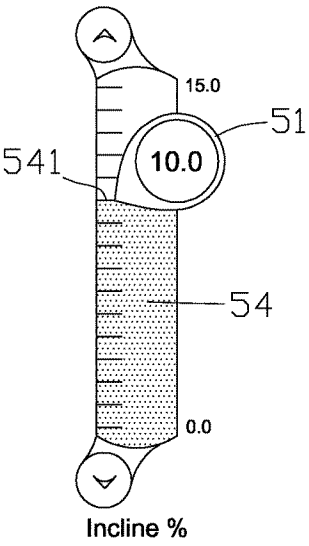
Fig. 4-e

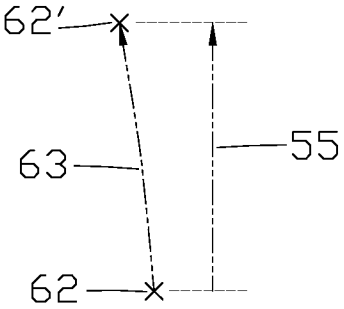
Fig. 5-c
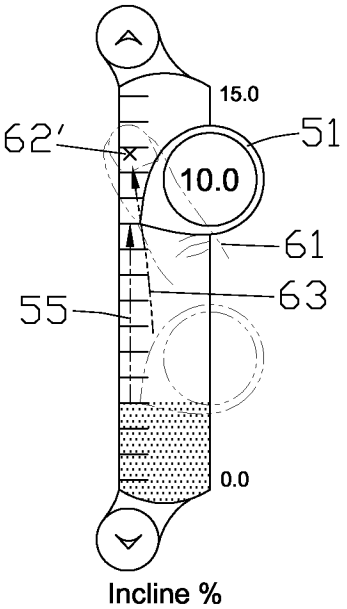
Fig. 5-b
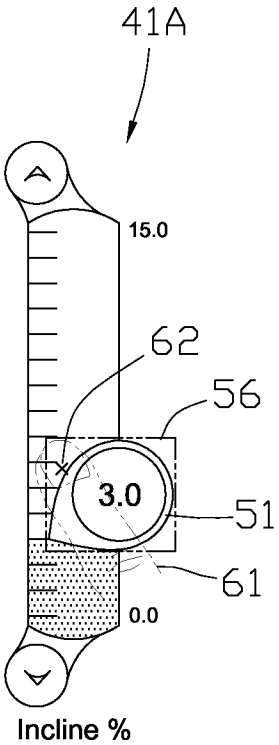
Fig. 5-a

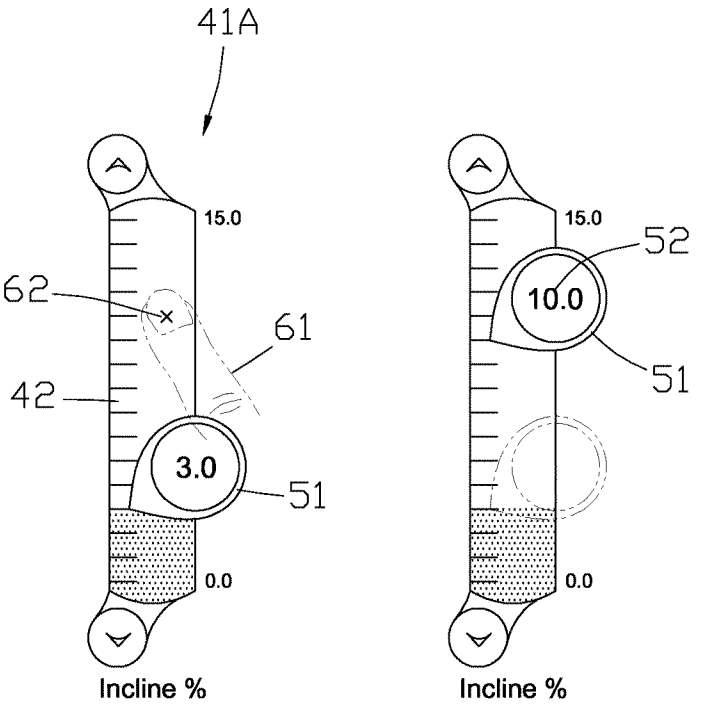
Fig. 6-a
Fig. 6-b
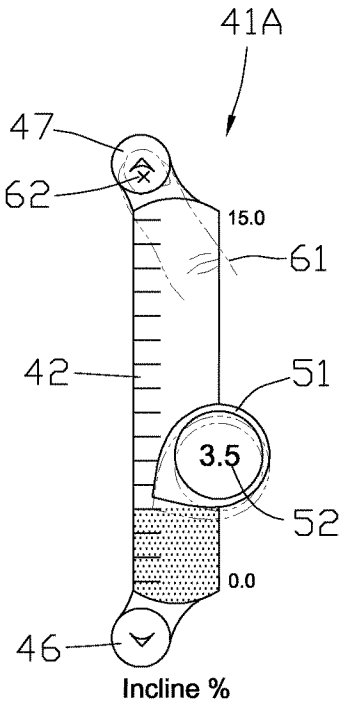
Fig. 7-a
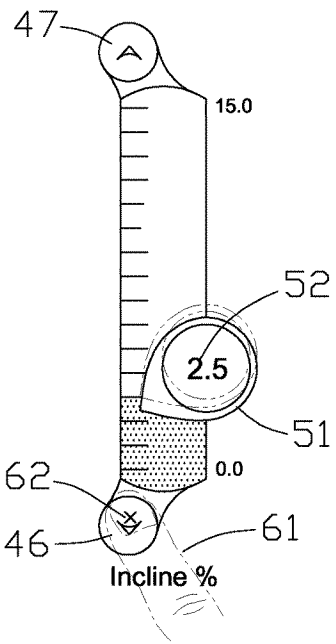
Fig. 7-b

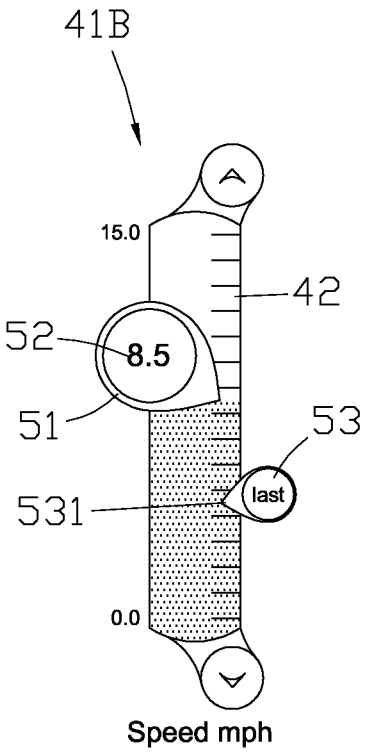
Fig. 8-a
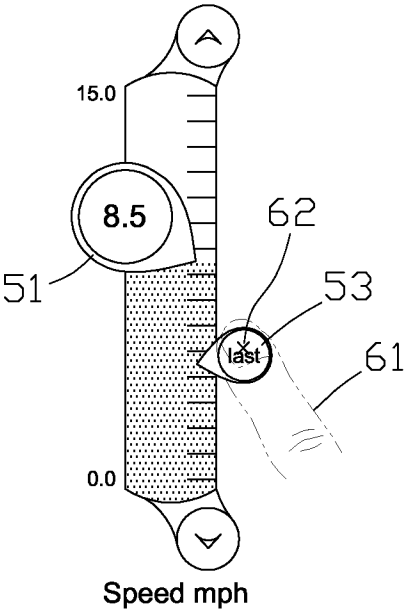
Fig. 8-b
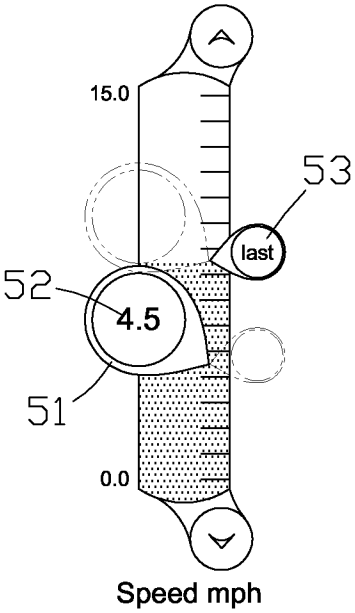
Fig. 8-c

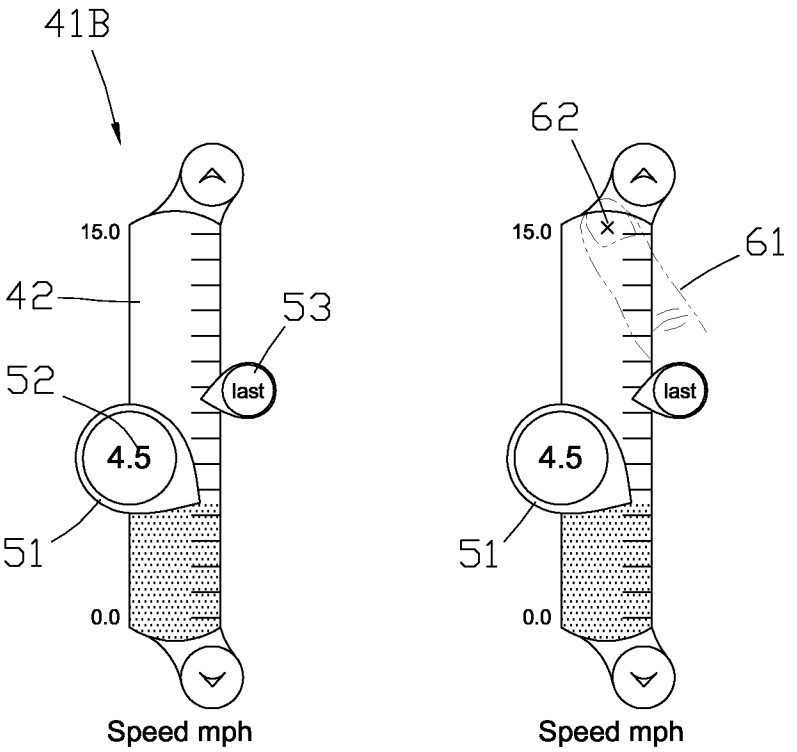
Fig. 9-a
Fig. 9-b
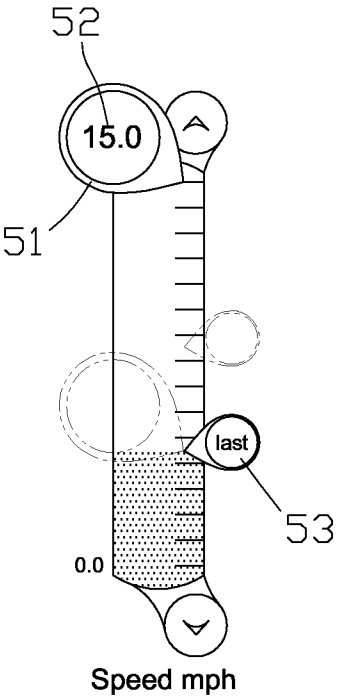
Fig. 9-c
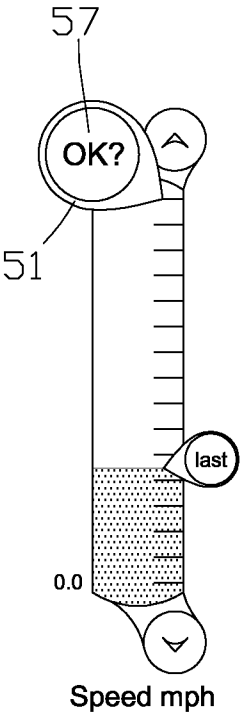
Fig. 9-d

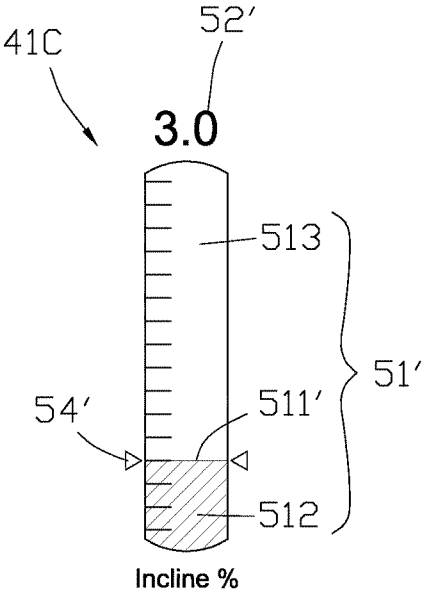
Fig. 10-a
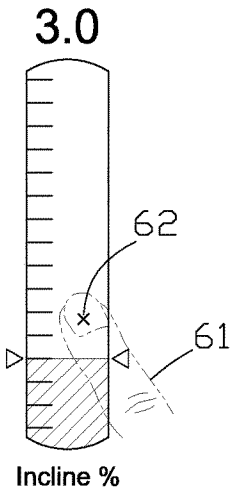
Fig. 10-b
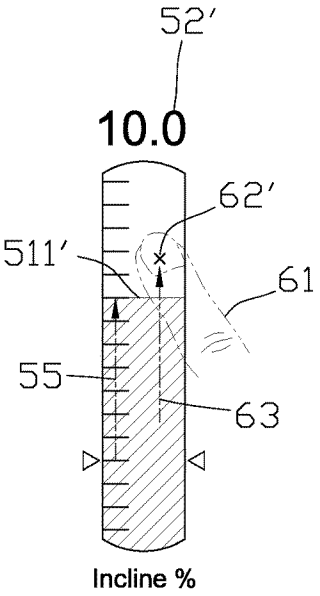
Fig. 10-c
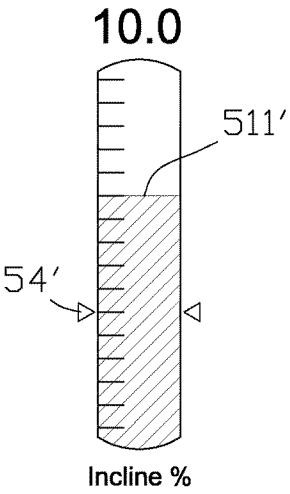
Fig. 10-d
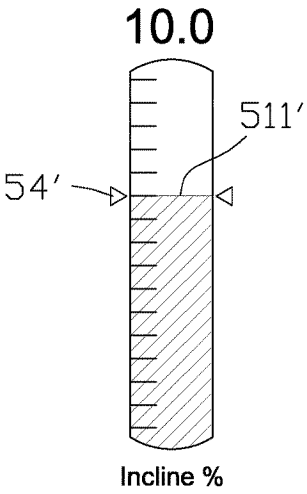
Fig. 10-e

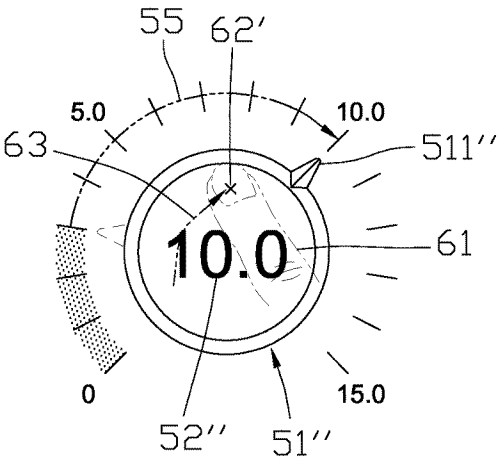
Fig. 11-c
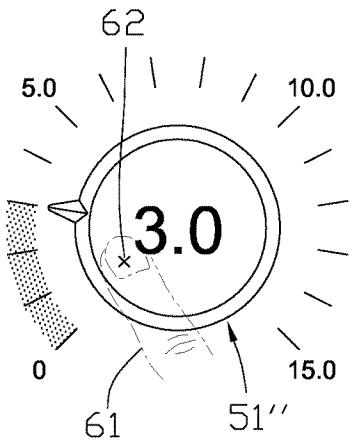
Fig. 11-b
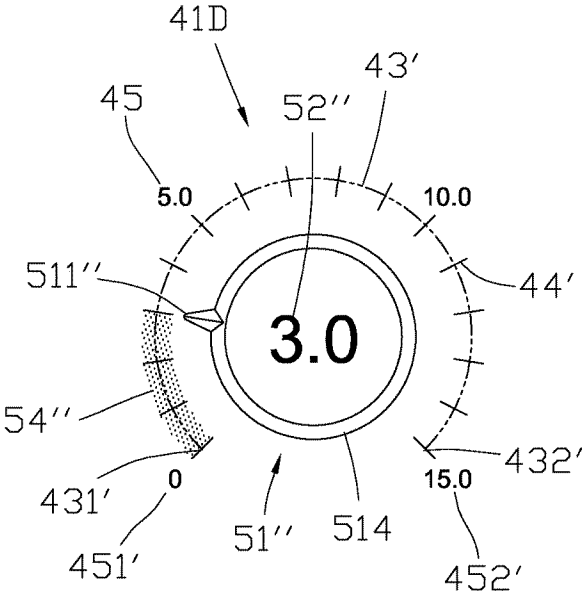
Fig. 11-a

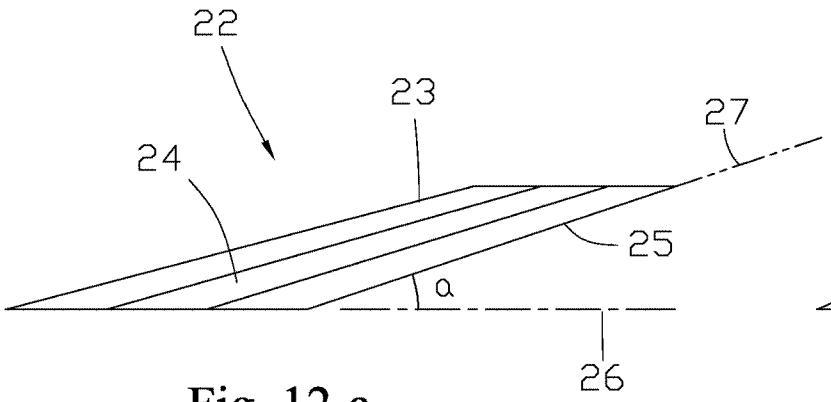
Fig. 12-a
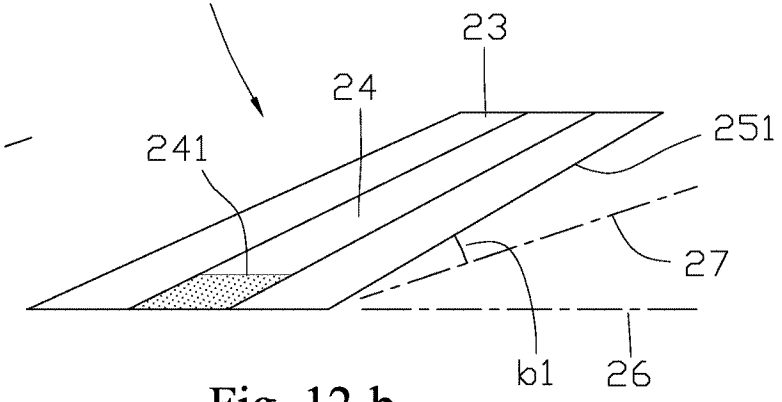
Fig. 12-b
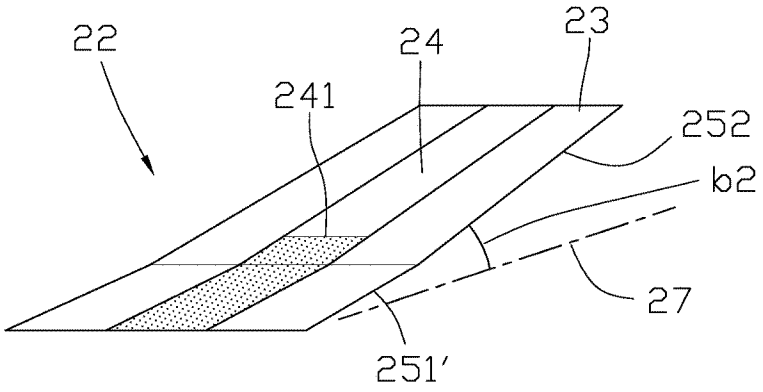
Fig. 12-c
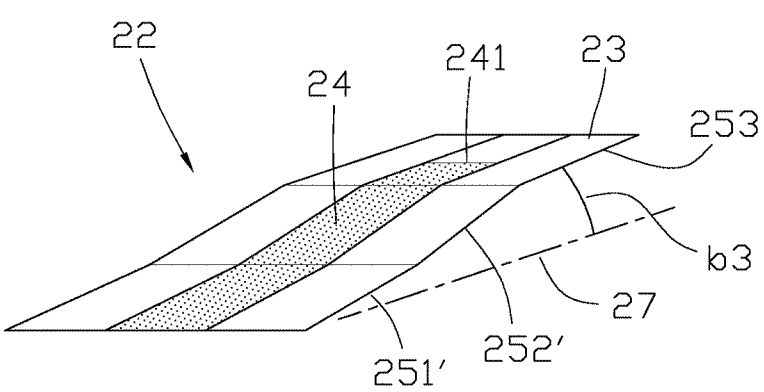
Fig. 12-d

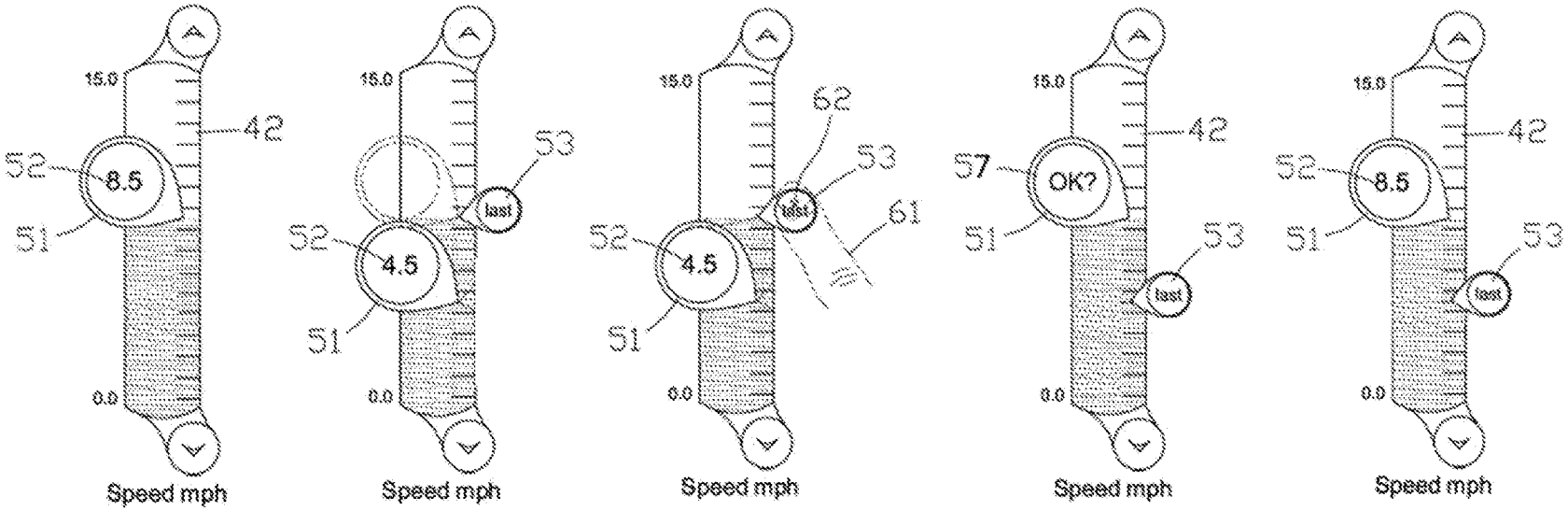
Fig. 13-a
Fig. 13-b
Fig. 13-c
Fig. 13-d
Fig. 13-e

METHOD OF CONTROLLING AN EXERCISE APPARATUS

CROSS-REFERENCE TO RELATED APPLICATION

This application is a continuation of U.S. patent application Ser. No. 13/738,954 filed on Jan. 10, 2013, which is a continuation of U.S. patent application Ser. No. 13/349,549 filed on Jan. 12, 2012, now U.S. Pat. No. 8,360,934, which is a continuation of U.S. patent application Ser. No. 12/605,375 filed on Oct. 26, 2009, now U.S. Pat. No. 8,113,990, which claims priority of Taiwan Invention Patent Application No. 098117912, filed on May 27, 2009.

BACKGROUND

1. Field of the Invention

This invention relates to an exercise apparatus and, more particularly to a method which facilitates operation of the exercise apparatus.

2. Description of the Related Art

General indoor exercise apparatus, such as treadmills, stationary bicycles, or steppers, usually have a console which has a control interface for a user to input orders and providing feedback to the user via image or audio. Prior control interfaces usually adopt a common input method that is disposed several keys which respectively have different functions on the console. The user can press corresponding keys according to his requirement. Besides, a common feedback method uses various LED to show information regarding to numerals, characters, or exercise process charts. Some advanced control interfaces use LCD screen to achieve the same feedback function. Furthermore, some control interfaces adopt touch screen which concurrently has the functions of input and feedback and can simplify the control interfaces by showing virtual keys on the touch screen.

No matter what kinds of exercise apparatus, setting "quantifiable exercise intensity", such as speed of a treadmill, incline angle of a treadmill, and resistance of a stepper, is almost the most used function. In prior control interface, value of the quantifiable exercise intensity is often displayed by a plurality of LED, or showed in numerals or characters. For example, prior control interface shows the characters of "3.5 mph" or "level 10" thereon. Besides, prior control interface usually provides several keys for inputting numerals from "0" to "9" and adjusting keys for a user to use these keys to control the exercise intensity.

However, it is inconvenient to use keys to control an exercise apparatus. For instance, if a user wants to adjust a present value of "7.0" to a new value of "3.5", generally, he may adopt one of following three methods. The first is touching keys corresponding to the numeral "3" and the numeral "5" in turn, and then touching an "Enter" key to input. The second is holding down a "minus" key to make the value of "7.0" keep decreasing until the value of "3.5". The third is touching a hotkey to make the value of "7.0" to become "4.0" or "3.0", and then pressing the "minus" key or a "plus" key five times or pressing over a period of time to achieve the values of "3.5". These methods are inconvenient and may waste much time.

Besides, prior control methods about displaying and adjusting the control interface have another disadvantage. Because prior control interface only displays the current value, the user can not simultaneously understand all of the information and the relationship therebetween. Therefore, when the user adjusts the exercise intensity, it is difficult for him to control variation. For example, a user can not understand what a numeral "3.5" means and the numeral is at high intensity or low intensity within the overall adjusting range as operating prior control interface of an exercise apparatus. When the user wants to exercise in the middle exercise intensity of the exercise apparatus or 1.5 times against current exercise intensity, it is hard for prior control method and control interface to achieve the requirements.

In addition, prior control interfaces often use and arrange a plurality of LED to show the exercise process chart for concretely presenting the exercise intensity during the exercising time. Usually, the plurality of LED composes of a LED matrix display. A transverse axle of the LED matrix display represents time and a vertical axle thereof represents the exercise intensity. A user can recognize the current exercise intensity and exercising time from the LED matrix display. But, the rise and fall boundary between light LED and dark LED often make the user have misunderstanding. For instance, when the user uses a treadmill, he may imagine the boundary as an incline real road. This is wrong, because the decline boundary does not represent a decline road.

SUMMARY

The present invention involves a method for controlling an exercise apparatus via a control interface of the exercise apparatus. Generally speaking, the present invention is capable of simultaneously displayed all of information regarding to the exercise apparatus to a user in an easy to understand format and allow the user for quickly and instinctively setting the exercise apparatus.

According to one aspect of the present invention, the method in a preferred embodiment includes: controlling a touch screen to display an information field thereon; graphically displaying an input zone having a plurality of sensing areas in the information field, the plurality of sensing areas constituting an adjusting path; displaying a first tag in the information field, the first tag having a portion pointing to a first sensing area of the input zone and displaying a parameter having a first value on the first tag corresponding to the first sensing area of the input zone; dragging the first tag along the adjusting path from the first sensing area to a second sensing area of the input zone; displaying a confirmation message on the first tag awaiting for a confirmation input; displaying a second value of the parameter on the first tag corresponding to the second sensing area of the input zone after receiving the confirmation input; operating the exercise apparatus from a first condition using the first value of the parameter to a second condition using the second value of the parameter; and displaying a second tag in the information field, the second tag having a portion pointing to the first sensing area of the input zone wherein the relative positions of the first and second tags graphically show the difference between the first and second values of the parameter.

According to another aspect of the present invention, a control unit has a display screen to show an information field, and a graphic history group is displayed therein for showing the transition about exercise intensity. The graphic history group substantially comprises a level indicator which is made up of one or more line segments. The number and the length of the line segments according to different time spans within entire exercising time. Each of the line segments respectively has an included angle relative to a base line of the information field. Each of the included angles is proportion to exercise intensity within corresponding exercising time span.

This summary is not meant to be exhaustive. Further features, aspects, and advantages of the present invention will become better understood with reference to the following description, accompanying drawings and appended claims.

BRIEF DESCRIPTION OF THE DRAWINGS

FIGS. 4-*a* to 4-*e* are diagrams which illustrate operation of dragging a first tag as a user operating the control interface of the preferred embodiment;

FIGS. 5-*a* to 5-*c* are diagrams about how the control interface of the preferred embodiment deals with an action of dragging on the input zone from the user;

FIGS. 6-*a* and 6-*b* are diagrams which illustrate operation of choosing a random position on the input zone as a user operating the control interface of the preferred embodiment;

FIGS. 7-*a* and 7-*b* are diagrams which illustrate operation of using a plus key and a minus key to adjust the first tag as a user operating the control interface of the preferred embodiment;

FIGS. 8-*a* to 8-*c* are diagrams which illustrate operation of using a second tag to control the first tag move to a specific location;

FIGS. 9-*a* to 9-*d* are diagrams for illustrating huge variation between a prior position of the first tag and a new position thereof;

FIGS. 10-*a* to 10-*e* are diagrams of a second embodiment of the present invention;

FIGS. 11-*a* to 11-*c* are diagrams of a third embodiment of the present invention; and FIGS. 12-*a* to 12-*d* are diagrams for illustrating a graphic history group in FIG. 2 of the preferred embodiment of the present invention.

FIGS. 13-*a* to 13-*e* are diagrams that illustrate operation of first and second tags with a confirmation query.

DETAIL DESCRIPTION

Figure 1:
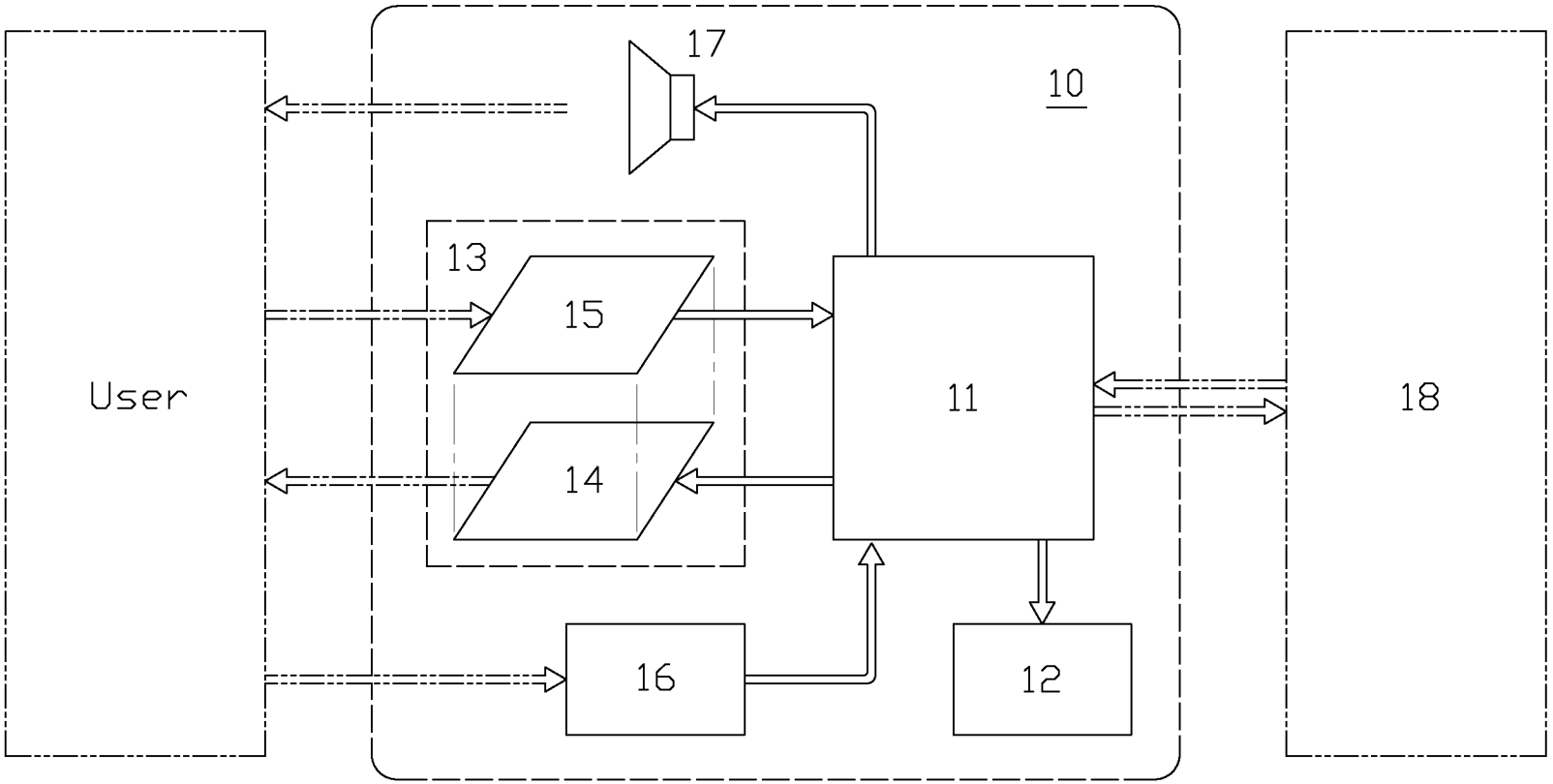
FIG. 1 is a block diagram of a control interface of a preferred embodiment constructed according to the principles of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

The present invention provides a method which facilitates operation of controlling cardio exercise apparatus such as elliptical cross trainers, steppers, stationary bikes and treadmills, and anaerobic exercise apparatus such as strength training machines. Generally speaking, the present invention provides a convenient method which is embedded in an instinctive control interface to make an exercise apparatus more user-friendly.

FIG. 1 shows a fundamental relationship among units of a control interface 10 of an exercise apparatus which illustrates the preferred embodiment. The control interface 10 comprises a control unit 11, a storage unit 12 which is electrically connected to the control unit 10, a touch screen 13, an audio output unit 17, and complementary input units 16. The control interface 10 is capable of accepting information inputted from a user and processes the information to control a mechanical assembly 18 to have corresponding acts. The control interface 10 is also capable of providing feedback on the status of the mechanical assembly 18 to the user via audio or image, therefore, the user can master the exercise apparatus.

The control unit 11 could be a CPU (Central Processing Unit) generally used in a computer system. The control unit 11 is used to recognize the information and process it properly. Essentially, the control unit 11 is a system itself which comprises at least one programming microprocessor and related hardware, software, or firmware. Details of the control unit 11 are regarded as prior art and should be appreciated by people skilled in the art.

The storage unit 12 is disposed for storing preset data or for temporarily saving data that is generated and used during the operation of the exercise apparatus. The storage unit 12 may comprise a ROM (Read-Only Memory) and a RAM (Random Assess Memory) which are commonly used in a computer system. The control unit 11 can read data from the storage unit 12 or save data therein. Practically, the control unit 11 and the storage unit 12 can be integrated into a single IC (Integrated Circuit) or an electrical module. Therefore, the storage unit 12 can also be regarded as part of the control unit 11.

The touch screen 13 comprises a display panel 14 and a transparent sensing panel 15 covered on the display panel 14. Generally, the display panel 14 is a LCD (Liquid Crystal Display) and can be controlled by the control unit 11 to display an information field 19 (illustrated as FIG. 2) for providing vivid visual information for the user. The sensing panel 15 can detect whether the surface of the sensing panel 15 is touched by the user and recognize touched locations, and transmit signals related to the touched locations to the control unit 11. The control unit 11 is capable of mapping the touched locations to a coordinate of the information field 19 through mathematical processes.

The complementary input units 16 comprise several input devices such as keys or emergency switch. The complementary input units 16 are disposed to assist or complement functions which the touch screen 13 does not provide. However, in particular embodiments, the present invention may not need the complementary input units 16.

Generally, the audio output unit 17 is a speaker for outputting audio information to the user. The audio information may be clicking sounds in order to provide feedback along with the tactile sense when the user presses the keys, or the audio information may be short melody prompts that alert the user to the status of the exercise apparatus.

Afore-mentioned are prior arts which are commonly used in a control interface of an exercise apparatus or computer equipments. Each of the units mentioned above are known by people skilled in the art so that the units are not described in detail. The present invention is related to contents of the information field 19 displayed by the touch screen 13 and interaction between the contents and a user.

Figure 2:
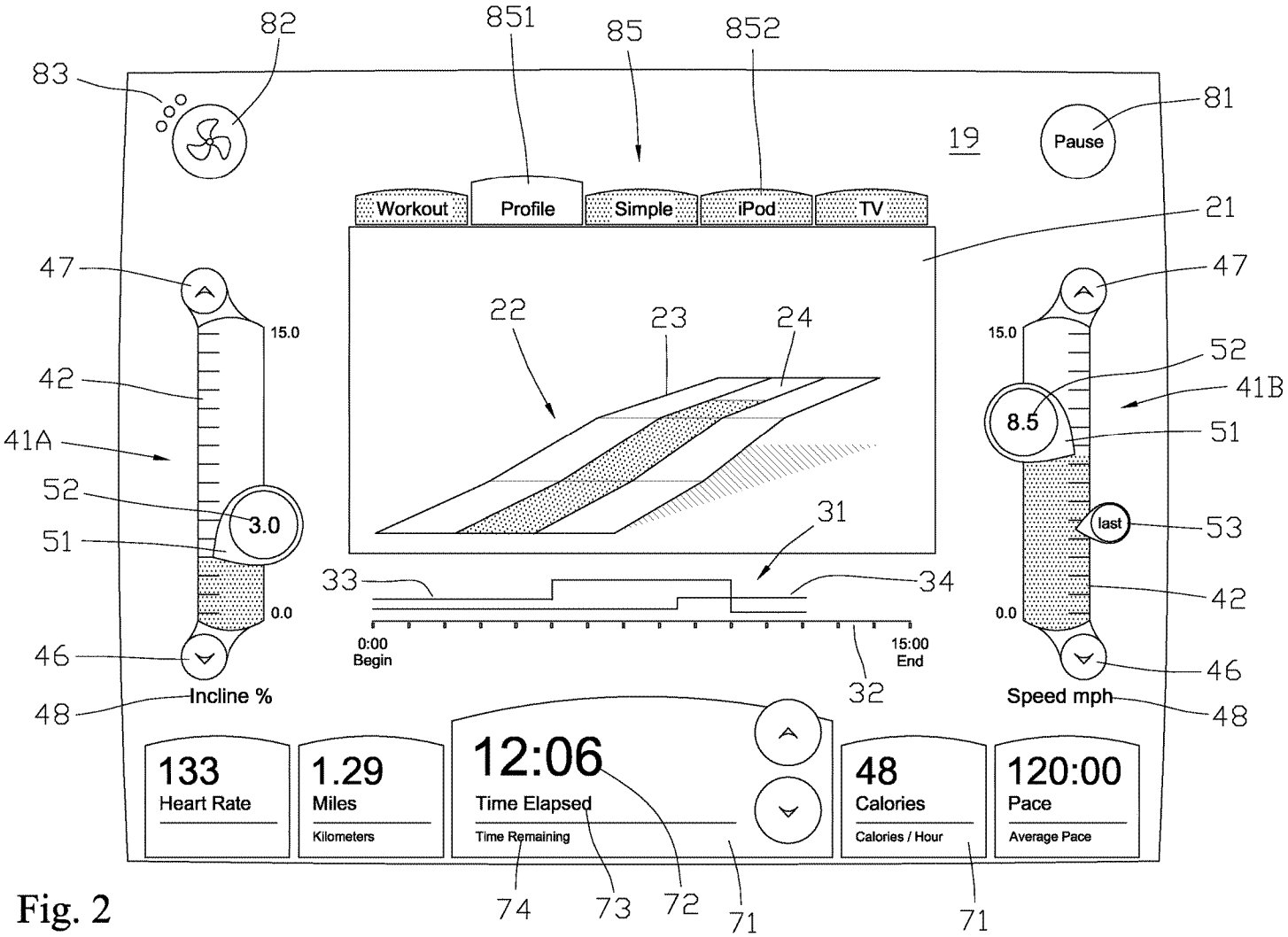
FIG. 2 is a diagram of the preferred embodiment which shows information regarding to a user as using an exercise apparatus.

In the current embodiment, the exercise apparatus is a treadmill. The control unit 11 directs the touch screen 13 to display an appropriate information field according to the status of the treadmill and/or a display mode which the user chose. As shown in FIG. 2, the information field 19 illustrated therein is representative of when the user is using the treadmill. (Numeral data contained in FIG. 2 are merely for illustration.) The information field 19 comprises an exercise history chart 21 displayed in the central portion of the information field 19, a first graphical setting group 41A and a second graphical setting group 41B respectively graphically displayed at the left and right sides of the information field 19, and several state partitions 71 displayed at the lower side of the information field 19.

In the embodiment, the first graphical setting group 41A is used to show the incline angle of the treadmill and can be operated to adjust the incline angle relative to the ground. The second graphical setting group 41B is used to show the speed of the treadmill and can also be operated to adjust the speed of the treadmill.

Referring to FIG. 4-*a*-4-*e*, only the first graphical setting group 41A is shown, but other than the fact that the first graphical setting group 41A displays and controls the incline angle of the treadmill, and the second graphical setting group 41B displays and controls the speed of the treadmill, it is to be understood that both the first and second graphical setting groups 41A, 41B operate in substantially the same way. Each of the first and second graphical setting groups 41A, 41B comprises a substantially rectangular input zone 42. Each of the input zones 42 presents a vertically extending adjusting path 43. Each of the adjusting paths 43 has a first end 431 (bottom end of the adjusting path) and a second end 432 (top end of the adjusting path). In the embodiment shown, there are sixteen calibration tails 44 between the first and second ends 431, 432 to equally divide the adjusting path 43 into fifteen segments. Furthermore, a minimum value 451 (0.0) and a maximum value 452 (15.0) are respectively marked beside the first end 431 and the second end 432 to teach a user the range of adjustment of the incline angle or the speed. In addition, there is also a minus key 46 and a plus key 47 respectively near the first end 431 and the second end 432 of the adjusting path 43. Indicia 48 marked under each of the first and second graphical setting groups 41A, 41B clearly show the corresponding adjustable matters and units thereof. For example, "Incline" and "%" are marked under the first graphical setting groups 41A, and "Speed" and "mph" are marked under the second graphical setting groups 41B.

The storage unit 12 contains much information, and a portion thereof is several groups of a range of values. Each of the groups of values is respectively corresponding to the adjustable matters of the treadmill. For example, there is a group of values within a specific range belonging to the incline angle and the other group belonging to the speed. In the embodiment, each of the adjustable matters has a range from the minimum value 0.0 to the maximum value 15.0 and the differential step value is 0.1. Therefore, the storage unit 12 may contains a group of one hundred and fifty-one values which are "0.0," "0.1," "0.2," . . . "14.8," "14.9," and "15.0," or an equation for calculating the series of numbers providing to the control unit 11 to read and apply. According to the numbers of the steps of each of the adjustable matters, the control unit 11 allots equal amount of sensing areas (not shown) to the adjusting path 43 of the input zone 42. According to the assigned position, each of the sensing areas respectively represents a value of the group. In other words, the sensing area located at the first end 431 of the adjusting path 43 represents the value "0.0", and the next upper sensing area represents the value "0.1" . . . the sensing area located at the second end 432 of the adjusting path 43 represents the value "15.0." The plurality of sensing areas constitutes the adjusting path 43. However, the arrangement of the plurality of sensing areas is not necessarily related to the segments of the input zone 42. In the embodiment, the input zones 42 of the first and second graphical setting groups 41A, 41B are separately divided into 15 segments and each of the segments are split up into 10 invisible sensing areas by a computer program. For example, each of the segments longitudinally covers twenty pixels of the touch screen 13 and each of the sensing areas is assigned two pixels in the embodiment. The sensing area is related to the resolution of the touch screen 13. While the embodiment shown divides both of the respective input zones 42 for the first and second graphical setting group 41A, 51B into 15 segments having one hundred and fifty one sending areas, there is nothing that requires both the first and second graphical setting groups to have identical input zones 42. For example, in other possible embodiments, one input zone 42 may be divided into three segments and the other input zone 42 may be divided into ten segments, but both of them could still have one hundred and fifty-one sensing areas. The number of sensing areas utilized in an input zone 42 is dependent upon many things, including the resolution of the sensing panel 15 and the size of the input zone 42.

Referring to FIGS. 4-1 through 4-*e*, each of the first and second graphical setting groups 41A, 41B further includes a first tag 51 and a parameter 52. The shape of the first tag 51 is similar to a water drop and the tip thereof is as an indicating portion 511. As shown, part of the first tag 51 is superimposed on the input zone 42. The first tags 51 are controlled by the control unit 11 and can be moved along the corresponding adjusting paths 43, so that the indicating portions 511 can point out the sensing areas. The parameter 52 is displayed superimposed on the first tag 51, where the parameter 52 displayed could be the speed of the treadmill, the incline angle of the treadmill, a resistance level, or some other information. Referring to FIG. 2, the first graphical setting group 41A represents and controls the incline angle of the treadmill, and the parameter 52 displayed on the first tag 51 associated with the first graphical setting group 41A represents a particular value of incline angle. Similarly, the second graphical setting group 41B represents and controls the speed of the treadmill, and the parameter 52 displayed on the first tag 51 associated with the second graphical setting group 41B represents a particular value of treadmill speed. As the each of the first tags 51 moves along the corresponding adjusting path 43, so each of the parameters 52 moves together with the corresponding first tags 51. The parameter 52 is capable of showing a value corresponding to a sensing area which is pointed out by the indicating portion 511 of the first tag 51. Referring to FIG. 4-*a*, the indicating portion 511 of the first tag 51 points to the $31^{st}$ sensing area counting from the sensing area located at the first end 431 of the adjusting path 43, so that the parameter 52 has the value of "3.0."

As previously mentioned, the user can clearly read not only a status of the treadmill but also the possible adjusting range of the present status through the display of the input zone, the first tag, and the parameter.

Figure 3:
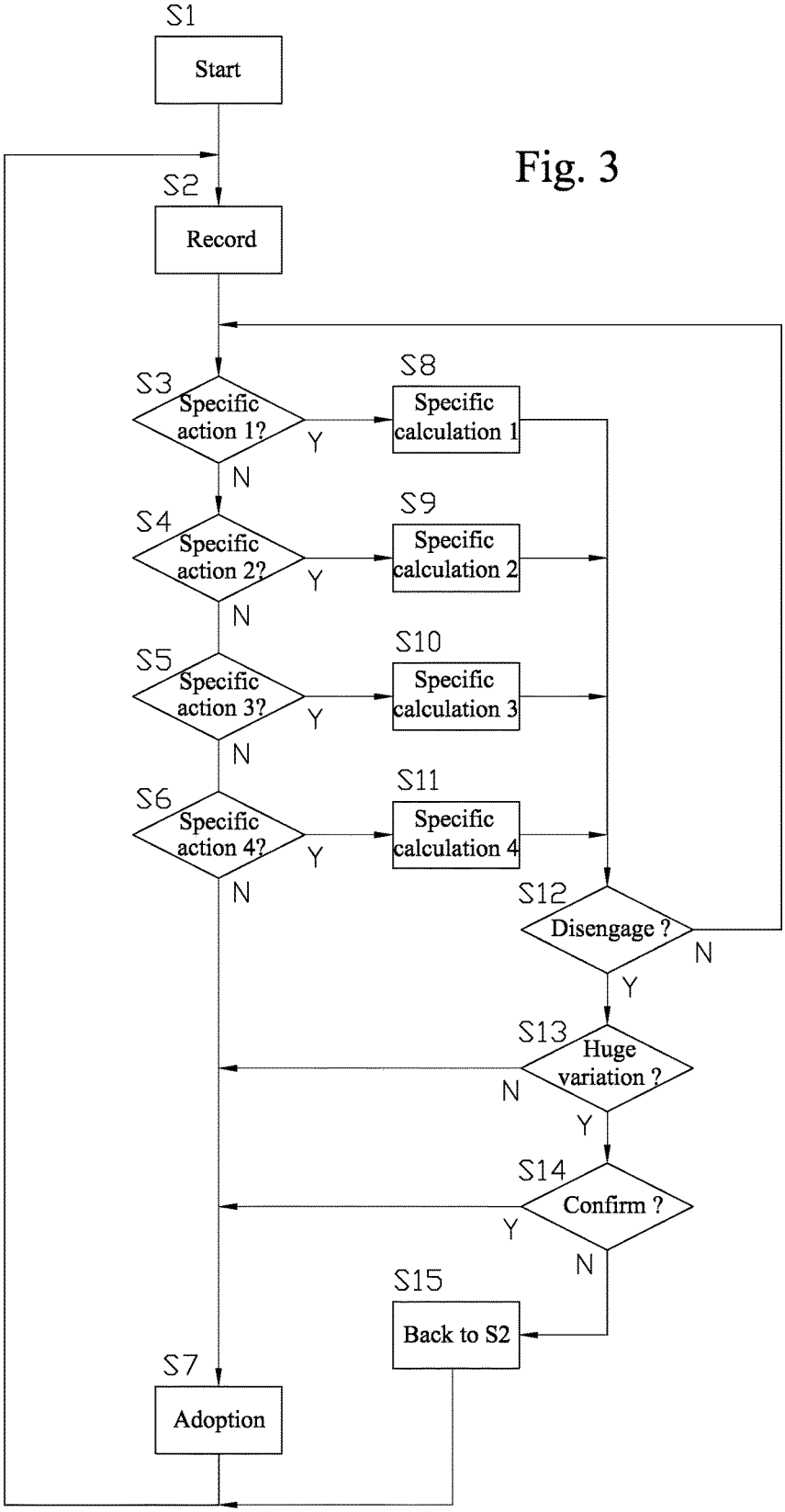
FIG. 3 is a process diagram of the preferred embodiment which is about how to set the exercise apparatus.

Referring to FIG. 3, the process of setting the incline angle and the speed of the treadmill is illustrated therein. Substantially, the process involves having the touch screen 13 display the information field 19, and then monitor the touch screen 13 to detect whether a touch has occurred on the surface of the touch screen 13 and where the touch is located relative to the first graphical setting group 41A or the second graphical setting group 41B. If the touch location is outside the area of these two graphical setting groups 41A, 41B, the touch is ignored by this process. If the touch location is inside the area of either the first or second graphical setting group 41A, 41B, the process determines which of the two graphical setting groups 41A, 41B are affected, and the process continuously monitors the touch screen 13 for specific actions from the user to determine how the corresponding first tag 51 should be relocated based upon these specific actions. After the user finishes the specific action, the relevant parameter 52 associated with the corresponding graphical setting group 41A, 41B is assigned a value based upon the new location of the first tag 51. The new value of the parameter 52 is adopted as a target and the treadmill starts to adjust the speed or the incline angle of the treadmill to conform to the target. The user can adjust the value of the parameter 52 repeatedly, thereby adjusting the speed or the incline angle of the treadmill as desired.

Referring to FIG. 3, in detail, the control unit 11 controls the touch screen 13 to display the information field 19 initially as step 1 (S1). Each of the incline angle and the speed has an initial value pre-saved in the storage unit 12, the control unit 11 also controls the first tags 51 of the first and second graphical setting groups 41A, 41B to respectively point to sensing areas which are respectively corresponding to the initial values. In the embodiment, both the initial values of the incline angle and the speed are "0.0". In other words, each of the first tags 51 initially is at the first ends 431 of the corresponding adjusting paths 43 and each of the parameters 52 initially has a value 0.0. Correspondingly, a running platform of the treadmill is horizontal and a belt which encompasses the running platform is static. In other embodiments of the invention, initial values of "age", "height", "weight", or others may not start at 0.0 but a common value, such as "weight" may have an initial value of 130 pounds for quick adjustment.

At step 2 (S2), the control unit 11 records the present sensing area which is pointed at by the first tag 51 as a first sensing area or the present value as a former status. If the user cancels following operation, the exercise apparatus can immediately revert back to the former status or stay in a status which is corresponding to the first sensing area.

In FIG. 3, step 3 to step 6 (S3~S6) show that the control unit 11 monitors the touch screen 13 to determine whether a touch from a user occurs on the surface of the touch screen 13, whether the touch conforms to the specific actions which are predetermined to adjust the treadmill, and where the touched location is. In the embodiment, there are four types of specific actions which are specific action 1, specific action 2, specific action 3, and specific action 4 for adjusting the incline angle and the speed of the treadmill. Specific action 1 is effectively a "point and drag" action, where a user can point at a current location of a first tag 51 and "drag" it to a new location. Specific action 2 is effectively a "point and set" action, where the user can touch the input zone 42 at a desired location to relocate the first tag 51 to the desired location. Specific action 3 is effectively an "incremental step" action, where the user can press a "plus key" to incrementally increase the value of the parameter 52, or a "minus key" to incrementally decrease the value of a parameter. Specific action 4 is effectively a "return to last setting" action, where the user indicates to a control unit 11 that he wants to reset the value of a parameter 52 to the last remembered value. Step 3 (S3), step 4 (S4), step 5 (S5), and step 6 (S6) are respectively designed to monitor and check for the aforementioned specific actions. Additionally, if the touch screen 13 is not touched or a touch action does not belong to the four types of specific actions in the process of step 3 to step 6 (S3~S6), the control interface 10 directly executes step 7 (S7), adoption, thereby maintaining the current settings. The control interface 10 temporarily adopts a value represented by a sensing area currently pointed at by the first tag 51 as an adjusting target. However, step 7 (S7) does not represent the end of the process illustrated in FIG. 3. The user can still adjust the exercise apparatus thereafter.

If a touch action belongs to one of the four types of specific actions in the process of step 3 to step 6 (S3~S6), the process will respectively proceed with step 8 (S8), step 9 (S9), step 10 (S10), or step 11 (S11) which are respectively specific calculation 1, specific calculation 2, specific calculation 3, and specific calculation 4.

After completing one of the calculation steps, step 8 to step 11 (S8~S11), the control unit 11 determines whether a specific action should be taken at step 12 (S12). If the specific action is determined at step 12 (S12) to be disengaged by the user, meaning that the control unit 11 determines that the user has disengaged contact with the touch screen 13, then the process will move on to step 13 (S13). If the user is still in contact with the touch screen 13, and therefore still performing one or more specific actions so that the user is not disengaged from the touch screen 13, the process will return back to step 3 to step 6 (S3~S6) and repeatedly process responses.

Regarding the specific action 1 and the specific calculation 1, if a user touches the display region of the first tag 51 in the information field 19 with his finger 61 and keeps contact with the region to move upward or downward, the control unit 11 will cause the first tag 51 to move correspondingly. From the perspective of the user, the user feels like he is using his fingertip to drag the first tag 51 along the adjusting path 43 of either the first or second graphical setting group 41A, 41B from one position to another in order to adjust the value of the parameter 52 associated with the corresponding graphical setting group 41A, 41B and the first tag 51. Referring to FIG. 4-*a*, the first tag 51 points to a sensing area which represents a first value "3.0". The touched location 62 shown in FIG. 4-*b* is moved to another touched location 62' shown in FIG. 4-*c* along a touching trajectory 63. The control unit 11 gets an equivalent trajectory 55 through calculation based on the touching trajectory 63. The equivalent trajectory 55 starts at the sensing area which represents the first value "3.0" and ends at another sensing area which represents a second value "10.0". The first tag 51 is controlled to move along the equivalent trajectory 55 from the position of the first value "3.0" to another position of the second value "10.0", thereby closely following the path of the touching trajectory 63. Meanwhile, the value shown by the parameter 52 is changed from "3.0" to "10.0" as shown in FIG. 4-*c*.

During the drag process, if the user completes the drag process over a very short time period, the first tag 51 may directly be relocated from the position where the first tag 51 is pointing to "3.0" to the position where the first tag 51 is pointing to "10.0." If the user completes the drag process over a relative long time period, the control unit 11 may repeatedly process the step 3 (S3) and the step 8 (S8) several times. Therefore, the user may see the first tag 51 gradually change position from "3.0" to "4.0" . . . until "10.0."

Referring to FIG. 4-*a*, each of the first and second graphical setting groups 41A, 41B further comprises a realistic index 54. In the embodiment, the realistic index 54 is a telescopic color bar extending upward from the first end 431 of the adjusting path 43. The top end of the realistic index 54 is formed as a designate portion 541. The sensing areas designated by the realistic indices 54 of the first and second graphical setting groups 41A, 41B respectively represent the current incline angle and the current speed of the treadmill. For instance, refer to FIG. 4-*a* to FIG. 4-*c*, where the first tag 51 of the first graphical setting group 41A is moved from pointing at the sensing area which represents the first value "3.0" to another sensing area which represents the second value "10.0". The second value "10.0" is adopted (step 7), and the control unit 11 then changes a first condition of the mechanical assembly 18 to a second condition of the mechanical assembly 18 to conform with the second value "10.0". That is, the incline angle corresponding to the first value "3.0" gradually increases to another incline angle corresponding to the second value "10.0". In the lifting process, the designate portion 541 of the realistic index 54 correspondingly gradually rises to immediately reflect the current condition as shown in FIG. 4-*c* to FIG. 4-*e*. In other words, in FIGS. 4-*a* through 4-*c*, the user drags the first tag 51 along the sensing area of the first graphical setting group 41A from a first sensing area pointing at a value of "3.0" to a new location, a second sensing area, pointing at a value of "10.0", and the first tag 51 immediately is moved to the new location to represent the target value of the incline angle. The control unit 11 will start to adjust the incline angle of the mechanical assembly 18 to match the target value of the incline angle. The designate portion 541 of the realistic index 54 corresponds to the actual incline angle of the mechanical assembly 18, thus displaying to the user the current actual incline angle of the mechanical assembly 18. As illustrated in FIG. 4-*d*, the designate portion 541 of the realistic index 54 moves toward the new location of the first tag 51 as the control unit 11 gradually changes incline angle of the mechanical assembly 18 to approach the target value of the incline angle of the mechanical assembly 18. As illustrated in FIG. 4-*e*, the control unit 11 stops adjusting the incline angle of the mechanical assembly 18 when the designate portion 541 of the realistic index 54 corresponds to the new location of the first tag 51, so that first tag 51 and the designate portion 541 of the realistic index 54 are both corresponding to the value of "10.0".

One of the conditions of invoking specific action 1 and specific calculation 1 is that the user must have his touch in the display region of the first tag 51 in the beginning. However, the display region is not limited to the contour of the first tag 51. For example, when a user touches a point within a rectangle 56 which circumscribes the first tag 51 as shown in FIG. 5-*a*, the control interface 10 still regards the touch as direct contact with the first tag 51. If it is desired to have a more strict standard, it is also possible to require the user to make his touched location 62 within the borders of the first tag 51.

As illustrated in FIG. 5-*a* and FIG. 5-*b*, if the touching trajectory 63 does not run completely parallel to the adjusting path 43, as long as the divergence therebetween is still within a predetermined tolerance range, the control unit 11 can still get the equivalent trajectory 55. As illustrated in FIG. 5-*c*, the length of the equivalent trajectory 55 is equal to a length which the touching trajectory 63 projects on the adjusting path 43.

Regarding the specific action 2 and the specific calculation 2, if a user touches a random position in the input zone 42, excluding the positions that would trigger specific action 1, the touched location 62 is superimposed on the sensing area corresponding to the input zone 42 and the control unit 11 directly relocates the first tag 51 to make the indicating portion 511 thereof point to the touched location 62. Referring to FIG. 6-*a*, the indicating portion 511 of the first tag 51 points to a sensing area which represents a value "3.0" and the touched location 62 is located on another sensing area which represents a values "10.0". The first tag 51 is subsequently relocated to the touched location 62 and the parameter 52 is correspondingly changed as shown in FIG. 6-*b*.

The specific action 1 and the specific action 2 may be complementary. For example, a user could use the specific action 2 to change the first tag 51 to a position and then use the specific action 1 to further adjust the position thereof. In this situation, the process in FIG. 3 is step 4 (S4), step 9 (S9), step 12 (S12), step 3 (S3) and step 8 (S8) in turn.

Regarding the specific action 3 and the specific calculation 3, illustrated in FIG. 7-*a*, when the first tag 51 is not at the second end 432 of the adjusting path 43, (i.e. the value represented by the sensing area is not the maximum value), and a user touches the plus key 47 which is near the second end 432 of the adjusting path 43, the first tag 51 will move to the next sensing area which is closer to the second end 432 of the adjusting path 43. That is, every touch on the plus key 47 increases the original value by the differential step value "0.1" to obtain a next value. For instance, the first tag 51 in the FIG. 7-*a* originally points to the sensing area representing a value "3.0". After one touch on the plus key 47, the first tag 51 is moved upwardly one differential incremental step to point to the next sensing area representing a value "3.1", and one more touch increases the value to become "3.2", then "3.3", "3.4", and finally "3.5". When a user keeps touching the plus key 47 over a period of time, it is as if the user is holding down a button to increase the value displayed, and the first tag 51 is moved upward continuously. Referring to FIG. 7-*b*, when a sensing area pointed by the first tag 51 is not at the first end 431 of the adjusting path 43, (i.e. the value represented by the sensing area is not the minimum value), a user touching the minus key 46 causes the first tag 51 to move to the next sensing area which is closer to the first end 431 of the adjusting path 43. In other words, every touch on the minus key 46 decreases the value by the differential step value "0.1". For instance, the first tag 51 in the FIG. 7-*b* originally points to the sensing area representing a value "3.0". After one touch on the minus key 46, the first tag 51 is moved downwardly one differential incremental step to point to the next sensing area representing a value "2.9", and one more touch decreases the value to become "2.8", then "2.7", "2.6", and finally "2.5". When a user keeps touching the minus key 46 over a period of time, it is as if the user is holding down a button to decrease the value displayed, and the first tag 51 is moved downward continuously.

The specific action 1, the specific action 2, and the specific action 3 may also be complementary. For example, a user could use the specific action 2 to reposition the first tag 51 from pointing from a first value to a second value. Possibly, the second value may be very close the exact target value desired by the user. The user can then take the specific action 3 to make the first tag 51 move up or down to obtain a third value corresponding to the exact target value.

Regarding the specific action 4 and the specific calculation 4, illustrated in FIG. 8-*a*, the second graphical setting group 41B further comprises a second tag 53. The shape of the second tag 53 is also similar to a water drop. The tip 531 thereof points to a sensing area. When a user touches the second tag 53, the control unit 11 relocates the first tag 51 pointing back to the position of the second tag 53 as shown in FIG. 8-*b* and FIG. 8-*c*.

In the embodiment, the current position of the sensing area pointed to by the second tag 53 is the former position of the first tag 51. As illustrated in FIG. 8-*c*, a treadmill that was currently set to run at a speed of 4.5 mph is currently set to run at a speed of 8.5 mph. The first tag 51 is pointing to the sensing area representing the current value "8.5" of the second graphical setting group 41B, while the second tag 53 is pointing to the sensing area representing the previous value of "4.5". When the first tag 51 is moved from the sensing area representing a first value "8.5" to next sensing area representing a second value "4.5", meanwhile, the second tag 53 is moved to the former position of the first tag 51 and points to the latest sensing area representing the first value "8.5". And the treadmill is operated from a first condition corresponding to the first value "8.5" to a second condition corresponding to the second value "4.5". A user can touch the second tag 53 to conveniently switch the first tag 51 back to the former position and operate the treadmill to a third condition corresponding to the former position. The treadmill can quickly revert back to the previous condition with just a single touch by the user. An additional benefit is that the information field 19 graphically displays the current value of the parameter 52, the previous value of the parameter 52, the difference between the two, and the actual current operating condition of the mechanical assembly 18. Referring to FIG. 8-*a*, the current target speed of the treadmill is 8.5 mph, the actual speed of the treadmill is also 8.5 mph (as displayed by the designate portion 541 of the realistic index 54), the previous target speed of the treadmill had been set to 4.5 mph, and a user can graphically see the difference between the current value target speed and the previous value of the target speed by observing the distance between the first tag 51 and the second tag 53. All of the information is displayed simultaneously to the user in an easy to understand format. In the invention, the second tag 53 is capable of showing the value which is corresponding to the sensing area pointed by the second tag 53.

In the program process, after adopting the value (step 7) represented by a current sensing area which is pointed at by the first tag 51, the second tag 53 is displayed so as to point at value that was previously pointed at by the first tag 51. For example, referring to FIG. 8-*a*, the first tag 51 points to the sensing area representing the first value "8.5". The sensing area is adopted as the first sensing area. When a user uses the specific action 1 to drag the first tag down, or first up and then down, the first tag 51 is finally dragged to point to the next sensing area which represents the second value "4.5" and the user release his finger 61 from the first tag 51 and disengaged from operation as shown in FIG. 8-*c*. The second value "4.5" is adopted via the step 7 (S7). The second tag 53 will be displayed to point to the first sensing area which represents the value "8.5" rather than any sensing areas pointed at by the first tag 51 during the drag process.

At the step 12 (S12) of the process illustrated in FIG. 3, when the control unit 11 monitors that the user had stopped touching the touch screen 13 or a touched location can not be recognized, the control unit 11 will regard the user as disengaged from operation. Subsequently, the control unit 11 will take the step 13 (S13) to calculate whether the change in the value of the parameter 52 is a huge variation from the previous value of the parameter 52. That is, the control unit 11 calculates the difference between the new value and the prior value, and determines if this calculated difference is greater than or equal to a predetermined value. In the present embodiment, the predetermined value is 3 miles per hour. For example, if the prior value of the speed is 5 miles per hour and the new value is 8 miles per hour, the control unit 11 will then proceed to the step 14 (S14). If the prior value is 5 miles per hour and the new value is 7 miles per hour, the control unit 11 will then proceed to the step 7 (S7) to adopt the value of 7 miles per hour and start to change the speed.

At the step 14 (S14), the information field 19 displays a message to query the user whether they confirm that they want to make this change in speed, and the control unit 11 monitors whether the user makes a confirmation input. When the confirmation input is received, the control unit 11 will then proceed to the step 7 (S7). If the confirmation input is not received, the control unit 11 proceeds to the step 15 (S15), resets the value of the parameter 52 to its previous value, displays the first tag 51 in its previous location, and then proceeds to the step 2 (S2). In other words, previous operation is all canceled.

As illustrated in FIG. 9-*a* to FIG. 9-*d*, the user adjusts the current value from "4.5 mph" to the maximum value "15.0 mph" and disengages from operation. The control unit 11 estimates the difference is greater than the predetermined value of 3 miles per hour and displays a confirmation message 57 on the first tag, such as the confirmation message 57 "OK?" shown on the first tag 51 in FIG. 9-*d*. Preferably, the confirmation message and the value "15.0" could be displayed intermittently to remind the user. If the user touches the confirmation message within a predetermined time span of 3 seconds or 5 seconds, the control unit 11 will regard the touch as receiving the confirmation input. If the user does not touch the confirmation message within the predetermined time span, the control unit 11 will proceed to the step 15 (S15) and the first tag 51 and the second tag 53 will respectively be returned to the initial positions as depicted in FIG. 9-*a*.

In another example shown in FIG. 13-*a*, a first speed value, such as 8.5 mph, is displayed as parameter 52 in a first tag 51 in the information field and the exercise apparatus is operated under a first condition using the first speed value of 8.5 mph. The user then touches the plurality of sensing areas of the input zone 42 to set a second speed value, such as 4.5 mph, and the second speed value is displayed as parameter 52 in the first tag 51 in the information field, as shown in FIG. 13-*b*. The exercise apparatus is then operated under a second condition using the second speed value of 4.5 mph and a second tag 53 is displayed in the information field associated with the first speed value (8.5 mph), as shown in FIG. 13-*b*. The user then touches the second tag 53 in the information field as shown in FIG. 13-*c*, and a confirmation query 57 is displayed in the information field because the first speed value (8.5 mph) is 3 miles per hour greater than the second speed value (4.5 mph), as shown in FIG. 13-*d*. The confirmation query 57 awaits confirmation from the user. Positive control associated with the confirmation query, such as the user touching the confirmation query 57, is received from the user. The first speed value (8.5 mph) is then displayed as parameter 52 in the first tag 51 in the information field 19 as shown in FIG. 13-*e*, and the exercise apparatus is then operated under a third condition using the first speed value.

The action of the user touching the confirmation message can be taken as a positive control, and the action of the user not touching (or the inaction of the user to touch) the confirmation message can be taken as a negative control. In a possible embodiment, a cancel icon (not shown) may be displayed in the information field 19. An action of touching the cancel icon is regarded as the negative control. When the control unit 11 receives the positive control, or when the control unit 11 does not receive a negative control within a predetermined time span, the first tag 51 is displayed to point to the new sensing area. When the control unit 11 receives the negative control, or when the control unit 11 does not receive the positive control within a predetermined time span, the first tag 51 is relocated and back to point to the first sensing area.

The overall procedures from the step 1 (S1) to the step 7 (S7) as illustrated in FIG. 3 can be recursively executed. The user can repeatedly adjust the position of the first tags 51 to change the value of one or more parameters 52. In the present embodiment, the step 7 (S7) is executed when the control unit 11 monitors that the user had disengaged from operation in step 12 (S12). In other possible embodiments of the invention, the step 7 (S7) may be directly executed after one or more specific actions (S3, S4, S5, or S6) and the associated specific calculation (S8, S9, S10, or S11), without going though step 12 (S12), step 13 (S13), step 14 (S14), or step 15 (S15).

FIG. 10-*a* to FIG. 10-*e* illustrate another embodiment of the graphic setting group of the present invention. A tag 51' of a graphic setting group 41C is filled in an input zone of the graphic setting group 41C. The tag 51' comprises a first color block 512 which extends upwardly and a second color block 513 which extends downwardly. The boundary between the first color block 512 and the second color block 513 forms an indicating portion 511' to indicate a sensing area on a vertical adjusting path. A parameter 52' is shown on the second end 432 of the adjusting path 43. A realistic index 54' is presented as two opposite arrows positioned at the sides of the adjusting path to visually display a value representative of the current status of a mechanical assembly. When a touched location is in the input zone and dragged along a touching trajectory 63 from one position to another, the indicating portion 511' of the tag 51' correspondingly rises or descends according to an equivalent trajectory 55 calculated based on the touching trajectory 63. If a user touches a random chosen position in the input zone without dragging, the indicating portion 511' of the tag 51' will directly be repositioned to the chosen position.

FIG. 11-*a* to FIG. 11-*c* illustrate third embodiment of the graphic setting group of the present invention. An adjusting path 43' of the graphic setting group 41D has an arc shape. There are a minimum value 451' "0" and a maximum value 452' "15.0" respectively marked at the ends 431', 432' of the adjusting path. In addition, there are several numerals 45 marked between the ends 431', 432' for convenience. A tag 51" comprises a circle portion 514 located at the centerpoint of the arc-shaped adjusting path 43' and an indicating portion 511" located at the periphery of the circle portion 514. A parameter 52" is shown at the center of the circle portion 514 of the tag 51". When a touched location 62 is in the display region of the tag 51" and dragged to another location 62' along a touching trajectory 63, the indicating portion 511" of the tag 51" is correspondingly rotated along an equivalent arc trajectory 55 calculated based on the touching trajectory 63, similar to rotating a circular knob.

Referring to FIG. 2, the exercise history chart 21 comprises a graphic history group 22 for showing the transition of the incline angle of the treadmill. Referring to FIG. 12-*a* to FIG. 12-*d*, the graphic history group 22 comprises a level indicator 23 and a time index 24. In the present embodiment, the level indicator 23 is displayed as a slightly convergent rectangular area, representing a stylized road shown in perspective, traveling from the left to the right, with the bottom portion of the road closer to the user, and the upper portion of the road farther away. A base line 27 is shown in FIGS. 12-*a* through 12-*d*. The base line represents one longitudinal edge of the level indicator 23, assuming that the treadmill remains horizontal throughout the entire exercise. However, the treadmill is not required to remain horizontal, so the one longitudinal edge of the level indicator 23 is made up of one or more line segments, and these one or more line segments make up the trajectory 25. The trajectory 25 has two distal ends, and may be collinear with the base line 27, or it may be a single line that is not collinear with the base line 27, or it may be altered to become several line segments according to the exercise history. For example, for a fifteen minute exercise, a level indicator 23 is displayed on the information field. At the beginning of the exercise, the level indicator 23 is displayed having a longitudinal edge that is collinear with the base line 27, and this longitudinal edge is the trajectory 25. There is an initial included angle "a" between the base line 27 and a horizontal line 26 of the information field 19 as shown in FIG. 12-*a*. The included angle "a" allows the level indicator 23 to appear as if it is being seen in perspective. When the trajectory 25 of the level indicator 23 is displayed at an angle that is equal to included angle "a", the trajectory 25 expresses a horizontal status of the running platform of the treadmill. When a user adjusts the incline angle from the initial value of "0.0", representing a horizontal running platform of the treadmill, to "7.0", the control unit 11 controls the graphic history group 22 to increase the angle between a horizontal line 26 and the trajectory 25 along the one longitudinal side of the level indicator 23 so that the angle is greater than the initial included angle "a", as shown in FIG. 12-*b*. That is, the upper-right of the level indicator 23 rises. The trajectory 25 is displayed as a more inclined second line 251' which has an included angle "b1" relative to the base line 27 which represents the horizontal running platform. After five minutes have passed, the user adjusts the incline angle from the value of "7.0" to "12.0", and the trajectory 25 forms a third line 252' which has a greater included angle "b2" relative to the base line 27 as shown in FIG. 12-*c*. When the user has exercised ten minutes, he adjusts the incline angle again from the value of "12.0" to "3.0". The trajectory 25 then forms a fourth line 253 which has a included angle "b3" relative to the base line 27 as shown in FIG. 12-*d*. As depicted in FIG. 12-*d*, the length of the second line 251', the third line 252', and the fourth line 253 are the same and respectively represent the initial five minutes, the middle five minutes, and the last five minutes of the fifteen minutes exercising time. Furthermore, the proportion of the included angles b1, b2, and b3 is 7:12:3. Each of the proportions represents the value of the incline angle at corresponding time intervals. Therefore, the level indicator 23 can represent a stylized road shown in perspective to allow a user to recognize the status of the running platform instantly and correctly. The display technique can also be used to graphically show resistance of a stationary bicycle or an elliptical cross trainer.

As the exercise progresses, the time index 24 gradually increases the length of a colored bar along the level indicator 23 from the lower-left to the upper-right. The distal end 241 of the time index 24 indicates the current time.

While the level indicator of the present invention has been described in terms of certain preferred embodiments, one of ordinary skill in the art of the invention will recognize that additions, deletions, substitutions, modifications and improvements can be made while remaining within the scope and spirit of the invention. For instance, the level indicator 23 of the present invention is described in this embodiment as a two dimensional representation of a three dimensional "road", but a completely two dimension representation is also possible. Additionally, the time index 24 is described as a colored bar moving along the level indicator 23, but it is not constrained to this embodiment.

Referring to FIG. 2, there is a history curve chart 31 below the graphic history group 22. The history curve chart 31 comprises a horizontal time axis 32, a first curve 33 which represents the incline angle, and a second curve 34 which represents the speed.

The state partitions 71 displayed at the lower side of the information field 19 are used for displaying various arguments related to the exercise process, such as "time elapsed", "calories", and "heart rate." Each of the state partitions 71 comprises an argument 72, a title of the current argument 73, and a title of a candidate argument 74. A user can switch the current argument 73 and the candidate argument 74 by touching the corresponding state partition 71. For example, "time elapsed" can be switched to "time remaining."

There is a pause key 81 located at the upper-right corner of the information field 19. A user can touch the pause key 81 to stop the belt. There is a fan key 82 and three lamp symbols 83 located at the upper-left corner of the information field 19. A user can touch the fan key 82 to switch a status of a fan coupled on a console of the treadmill, switching the status of the fan between strong, middle, weak, or off. The three lamp symbols 83 are configured to change color between an "unlit" color and a "lit" color, so that all three lamp symbols are "unlit" when the fan is off, one lamp symbol is "lit" when the fan is blowing at the weak level, two lamp symbols are "lit" when the fan is blowing at the middle level, and three lamp symbols are "lit" when the fan is blowing at the strong level.

There is a group of page tags 85 above the exercise history chart 21. The group of page tags 85 comprises a current tag 851 and several candidate tags 852. Touching one of the page tags 85 can partially or totally change the information field 19 to display other information. For example, FIG. 2 is in the "profile" mode.

As described, by utilizing the method of the present invention to control an exercise apparatus, a user can intuitively recognize and control the current status of the exercise apparatus. By using a variety of graphs to show operational conditions of an exercise apparatus, a user can easily understand the current status of the exercise apparatus, as well as a multitude of possible ranges for changing the status of the exercise apparatus. The user can also conveniently and instantly change the parameters of an exercise apparatus. In addition, the user can directly recognize a detailed history of exercising process through the graphic history group.

The present invention does not require that all the advantageous features and all the advantages need to be incorporated into every embodiment thereof. Although the present invention has been described in considerable detail with reference to certain preferred embodiment thereof, other embodiments are possible. While the present invention has been described in terms of certain preferred embodiments, one of ordinary skill in the art of the invention will recognize that additions, deletions, substitutions, modifications and improvements can be made while remaining within the scope and spirit of the invention as defined by the attached claims.

What is claimed is:

1. A method of controlling an exercise apparatus, the method comprising:

displaying an information field on a touch screen and displaying an input zone having a plurality of sensing areas in the information field;

displaying a first speed value in a first tag in the information field and operating the exercise apparatus using the first speed value;

touching the plurality of sensing areas of the input zone to set a second speed value and displaying the second speed value in the first tag in the information field;

operating the exercise apparatus from a first condition of using the first speed value to a second condition of using the second speed value and displaying a second tag in the information field associated with the first speed value;

touching the second tag in the information field and displaying a confirmation query in the information field awaiting for confirmation if the first speed value is 3 miles per hours greater than the second speed value;

receiving positive control associated with the confirmation query; and displaying the first speed value in the first tag in the information field and operating the exercise apparatus from the second condition of using the second speed value to a third condition of using the first speed value.

2. The method of claim 1, further comprising a step of displaying a minus key and a plus key respectively near a first end and a second end of the input zone.

3. The method of claim 2, further comprising steps of touching the minus key to control the first tag to move closer to the first end and touching the plus key to control the first tag to move closer to the second end.

4. The method of claim 2, further comprising a step of touching the minus key to produce a differential decrement to the second speed value, or touching the plus key to produce a differential increment to the second speed value.

5. The method of claim 1, wherein the confirmation query is displayed on the first tag.

6. A method of controlling an exercise apparatus, the method comprising:

controlling a touch screen to display an information field thereon and displaying an input zone having a plurality of sensing areas in the information field;

touching the plurality of sensing area of the input zone to set a first speed value and displaying the first speed value in a first tag in the information field;

operating the exercise apparatus using the first speed value;

touching the plurality of sensing area of the input zone to set a second speed value and displaying the second speed value in the first tag;

determining if the difference between the first speed value and second speed value is greater than a predetermined value and displaying a confirmation query in the information field awaiting for confirmation if the difference between the first and second speed values is greater than 3 miles per hours; and receiving positive control associated with the confirmation query in the information field and operating the exercise apparatus from a first condition of using the first speed value to a second condition of using the second speed value.

7. The method of claim 6, further comprising a step of displaying a minus key and a plus key respectively near a first end and a second end of the input zone.

8. The method of claim 7, further comprising steps of touching the minus key to control the first tag to move closer to the first end and touching the plus key to control the first tag to move closer to the second end.

9. The method of claim 7, further comprising a step of touching the minus key to produce a differential decrement to the second speed value, or touching the plus key to produce a differential increment to the second speed value.

10. The method of claim 6, wherein the confirmation query is displayed on the first tag.

* * * * *